US008800334B2

(12) United States Patent
Ettore et al.

(10) Patent No.: US 8,800,334 B2
(45) Date of Patent: Aug. 12, 2014

(54) ROLLING MILL OF ROTATING EXPANDER TYPE FOR TUBULAR BODIES WITH TIP-STABILIZING SYSTEM

(75) Inventors: Cernuschi Ettore, Bareggio (IT); Fabrizio Marini, Cinisello Balsamo (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 735 days.

(21) Appl. No.: 12/736,995

(22) PCT Filed: May 29, 2009

(86) PCT No.: PCT/EP2009/056606

§ 371 (c)(1), (2), (4) Date: Nov. 30, 2010

(87) PCT Pub. No.: WO2009/147087

PCT Pub. Date: Dec. 10, 2009

(65) Prior Publication Data

US 2011/0154876 A1 Jun. 30, 2011

(30) Foreign Application Priority Data

Jun. 3, 2008 (IT) ..... MI2008A1012

(51) Int. Cl.

| | |
|---|---|
| ***B21B 19/04*** | (2006.01) |
| ***B21B 17/10*** | (2006.01) |
| ***B21B 39/20*** | (2006.01) |

(52) U.S. Cl.
USPC ..... 72/97; 72/209; 72/250

(58) Field of Classification Search
USPC ..... 72/96, 97, 365.2, 366.2, 208, 209, 100, 72/235, 370.01, 250, 367.1, 95
See application file for complete search history.

(56) References Cited

U.S. PATENT DOCUMENTS 2,261,937 A * 11/1941 Kelso ..... 72/97
4,602,493 A * 7/1986 Dobrucki et al. ..... 72/78

FOREIGN PATENT DOCUMENTS

| | | |
|---|---|---|
| GB | 299741 | 6/1927 |
| JP | 57044413 | 3/1982 |
| JP | 58070905 | 4/1983 |
| JP | 61074711 | 4/1986 |

* cited by examiner

*Primary Examiner* — Shelley Self
*Assistant Examiner* — Mohammad I Yusuf
(74) *Attorney, Agent, or Firm* — Stetina Brunda Garred & Brucker

(57) ABSTRACT

A rolling mill of rotating expander type for tubular bodies, comprising: working rollers (1, 2) arranged inclined with respect to the rolling axis; a tip (3) fitted on a beam (4), so that the tubular body is pushed in rotation between the rollers and the tip, and subjected to deformation in order to increase the perimeter; a tip-stabilizing system placed behind said tip, about the beam, and integrated in the rolling mill.

9 Claims, 5 Drawing Sheets

ROLLING MILL OF ROTATING EXPANDER TYPE FOR TUBULAR BODIES WITH TIP-STABILIZING SYSTEM

FIELD OF THE INVENTION

The present invention relates to a rolling mill of rotating expander type, for tubular bodies, with a tip-stabilizing system.

STATE OF THE ART

The rolling mill of rotating expander type (simply named "expander" in the art) is a hot rolling mill for seamless tubular bodies of oblique type, in which the tubular body is rolled between two motorized working rollers and a tip.

The rolling axes of the two rollers are arranged inclined with respect to the rolling axis by an angle β of about 60°. The horizontal plane containing the axis of the first roller is arranged at a height H1 under the horizontal plane passing through the rolling axis, while the axis of the second roller is in a plane over the horizontal plane passing through the rolling axis at a distance H2. In some embodiments, the distances H1 and H2 are identical, while in others they are slightly different.

The rollers are outside the tubular body (hereinafter simply named "tube") and push it so as to rotate onto the tip, which is instead inside the tube, with a resulting forward motion of helical type, so that the tube is subjected to a deformation process as it advances between the two rollers and the tip.

Specifically, the thickness of the tube, entering the rolling mill, is gradually reduced during the tube forward motion between the roller and the tip, so that the perimeter of the tube increases without substantially increasing the length of the tube between the rolling mill inlet and outlet.

The helical forward motion is determined by the simultaneous presence of angle β and distances H1 and H2 between the two roller axes.

The tip is fitted on a beam which is normally held by appropriate devices of the guiding triad type, placed at outlet side of the machine, commonly used on perforating rolling mills, which are gradually opened as the tubular body advances. The diameter of the tip must be smaller than the internal diameter of the tube at the rolling mill outlet, and thus its stability is not ensured per se, because it may oscillate inside the tube when it advances.

More specifically, while the tip is horizontally held by the action of the two rollers and the rolled material, on the vertical plane it is free to move within the clearance existing between the tip and the internal diameter of the expanded tube.

The expanded tube is vertically held by means of commonly known, fixed shaped devices named "lineal" in the art, which may be possibly replaced by idle rollers, which however may only contain the tube and not the tip in the deformation zone. At the output zone, the tube may be supported and contained in the open position by the guiding triads themselves, and possibly by portions of a channel which may be fixed or adjustable in height.

Some forward zones of the tube being machined may be identified in the contact area between the tip and the working rollers (see FIG. 4):

- Zone A: the tube comes in contact with the rollers in a converging zone and it gradually ovalized;
- Zone B: the tube reaches the minimum distance point, named "draft";

- Zone C: the diverging zone is entered and the tube is here in contact with tip and rollers, and its thickness is gradually reduced with a consequent diameter increase;
- Zone D: the tip and roller profiles are parallel and the tube is smoothed therebetween; in this zone, the ovalization is gradually reduced (the longest axis of the oval is nearly vertical);
- Zone E: in this zone, the expanded tube is detached from the tip and should completely recover the residual ovalization thus becoming round again.

Actually, mainly due to the tip not being adequately held on the vertical plane, the effect of the smoothing zone D is not completely effective in eliminating the helicoidal irregularities of the expanded tube thickness (residual irregularities remain on the tube profile, e.g. shapes such as progressive triangles, helix shapes or saw-tooth shapes may be seen), because the tip is free to oscillate on a plane which is either substantially vertical, or which slightly diverges from the vertical, considering the presence of variations of heights H1 and H2 of the roller axes.

A negative effect of imperfect roundness in the expanded section of the tube exiting the rolling mill is thus determined at the outlet of zone E, whereby the section is also ovalized and the tube shape is not perfectly rectilinear.

An attempt to solve these problems which includes the installation of a second machine, separated from the above-described rolling mill, is known, in which the tube is passed again between two rollers and a tip, with a smoothing effect. Actually, this system of known type is very cumbersome and very expensive, because these machines are in all cases large in size.

SUMMARY OF THE INVENTION

It is an object of the present invention to provide a rolling mill of rotating expander type for tubular bodies so as to solve the aforesaid problems.

A further object is to implement a method of machining a tubular body using said rolling mill.

The present invention thus intends to reach the above-described objects by providing a rolling mill of rotating expander type for tubular bodies, comprising:

- first working rollers, provided with rotating axes arranged inclined by a first angle β with respect to the rolling axis and placed at determined heights H1, H2 diametrically opposite to the rolling axis;
- a tip fitted on a beam, said tubular body being pushed so as to rotate between said first rollers and said tip, and subjected to a deformation for reducing the thickness and therefore increasing the perimeter;
- a tip-stabilizing system, placed behind said tip, about the beam, and integrated in the rolling mill.

A method of machining a tubular body which uses said rolling mill is also the object of the present invention.

The dependent claims describe preferred embodiments of the invention.

BRIEF DESCRIPTION OF THE DRAWINGS

Further features and advantages of the invention will be more apparent in the light of the detailed description of a preferred, but not exclusive, embodiment of a rolling mill illustrated by the way of non-limitative example, with the aid of the accompanying drawings, in which.

The same reference numbers and letters in the figures refer to the same elements or components.

DETAILED DESCRIPTION OF A PREFERRED EMBODIMENT OF THE INVENTION

Figure 1:
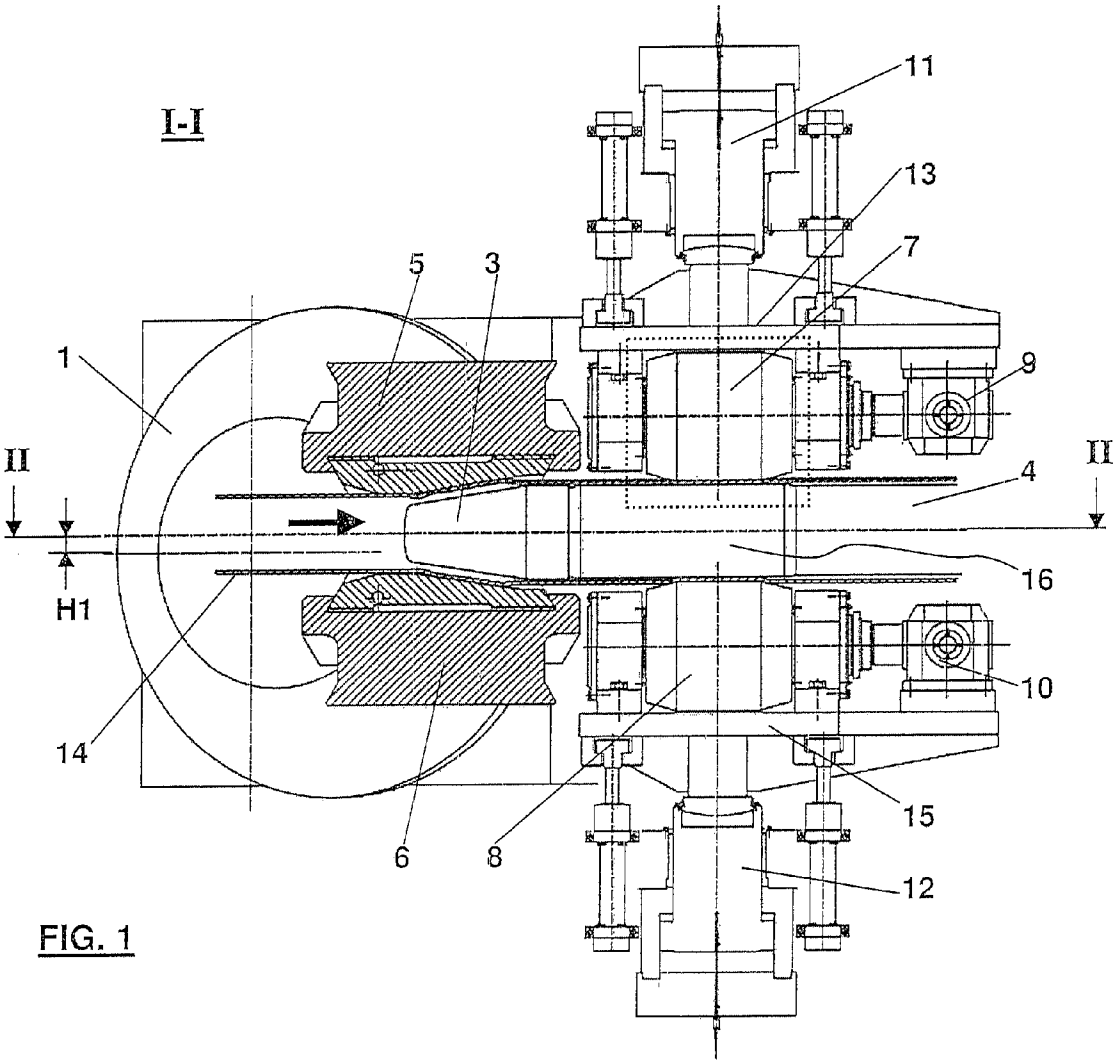
FIG. 1 shows a side view of the rolling mill according to the invention, taken along an intermediate section I-I.
Figure 3:
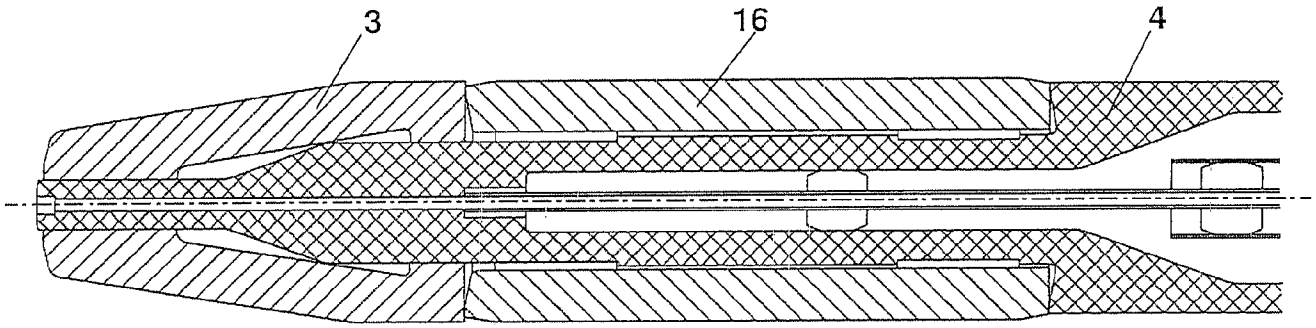
FIG. 3 shows an intermediate longitudinal section of the tip with the beam.

With reference to the figures, a rolling mill which has been properly modified by introducing a tip-stabilizing system is described in accordance with the present invention.

Numerals 1 and 2 indicate two working rollers with respective motorization system for their rotation, substantially known as previously described.

Numeral 3 indicates a substantially truncated cone tip, placed in a known manner, as previously described, fitted on a beam 4, in turn held in position by means of known devices, e.g. guiding triads, not shown in the figures.

Numerals 5 and 6 indicate known devices named "lineal" as previously described, placed perpendicularly to the positions of rollers 1 and 2, for holding the tube 14. The lineals may be possibly replaced with idle rollers, the replacement may be partial (only one lineal replaced with a roller) or total (both lineals replaced with rollers).

The tube 14 moves in the direction of the arrow shown in the figures.

In accordance with the present invention, a system for stabilizing the tip 3 is provided, placed behind the latter, about the beam, and integrated in the rolling mill.

In the non-limiting example described herein with reference to the figures, the stabilizing system comprises two rollers 7, 8, having a determined profile, described hereinafter, which engage the expanded-section tube at the rolling mill outlet, in positions which are diametrically opposite to the tube.

The effect of the roller pressure is to ovalize the tube and push it in contact with an element named "stabilizing ring" 16, placed behind the truncated cone part of the tip. The stabilizing ring essentially comprises a cylindrical part which may be either a part of the tip itself as extension of the truncated cone part thereof, or a separate component arranged on the beam.

The rollers 7 and 8 are rotated by means of respective motorization systems 9 and 10, and are held in the adjustable position by systems like hydraulic capsules, shown in the figure by numbers 11 and 12, or jacks, not shown, which push on respective plates 13 and 15 on which the rollers are pivoted.

The hydraulic capsules, the jacks and the plates may be made in a per se known manner.

Figure 2:
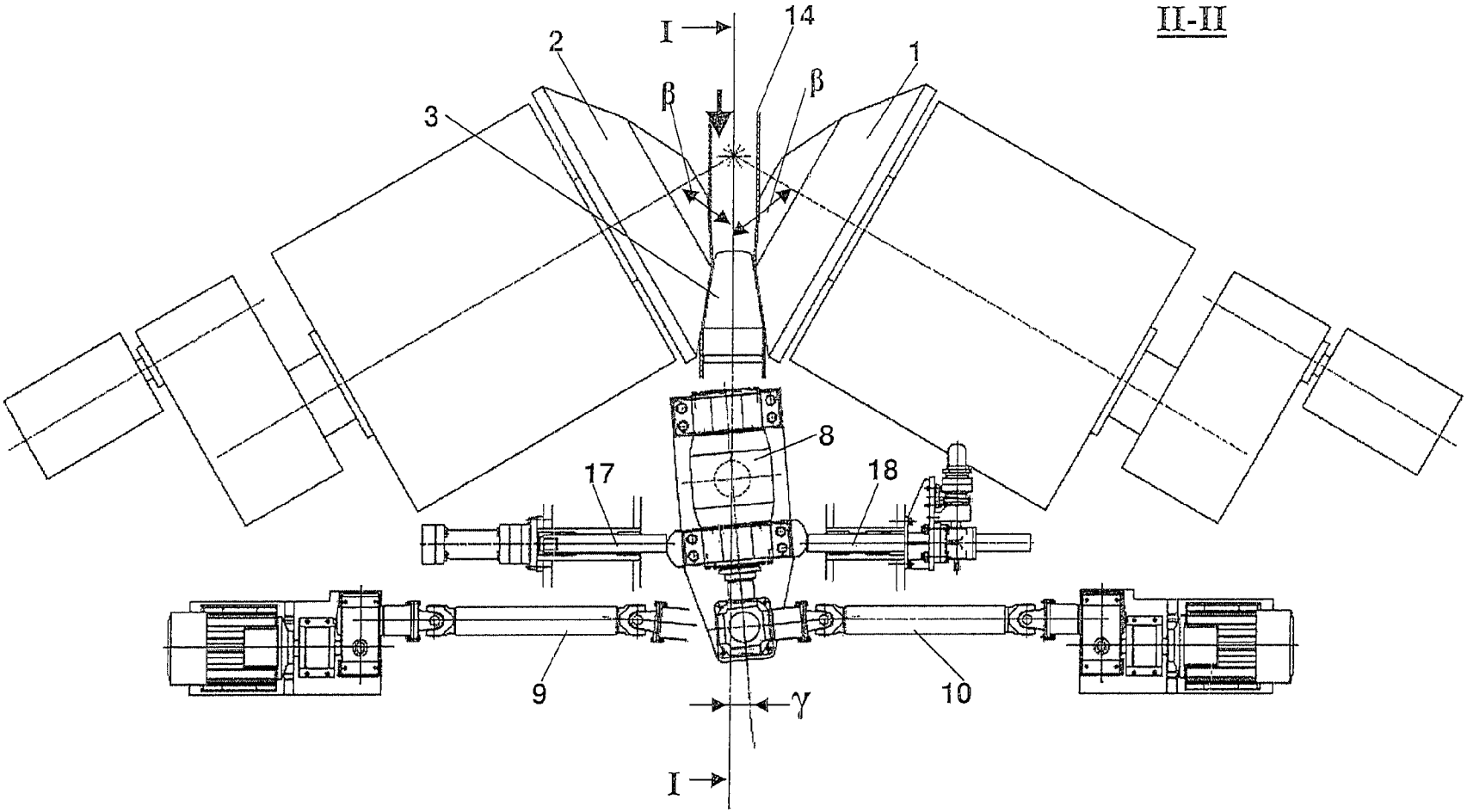
FIG. 2 shows a plan view of the rolling mill according to the invention, taken along an intermediate section II-II.
Figure 4:
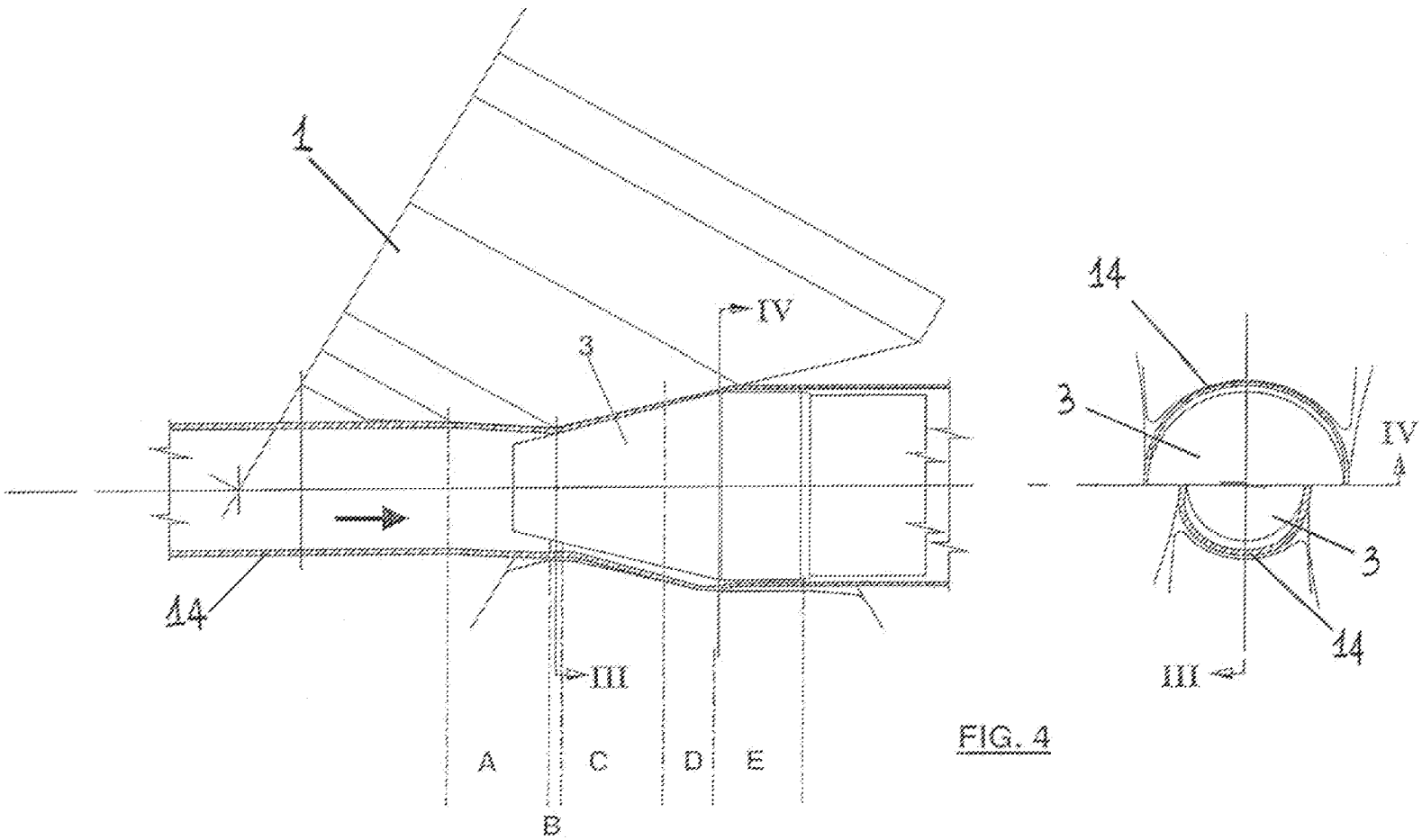
FIG. 4 shows an enlarged intermediate section of the area in FIG. 1 comprising tip 3, with zones from A to E highlighted, with two details of section III and IV being arranged by the side.
Figure 5:
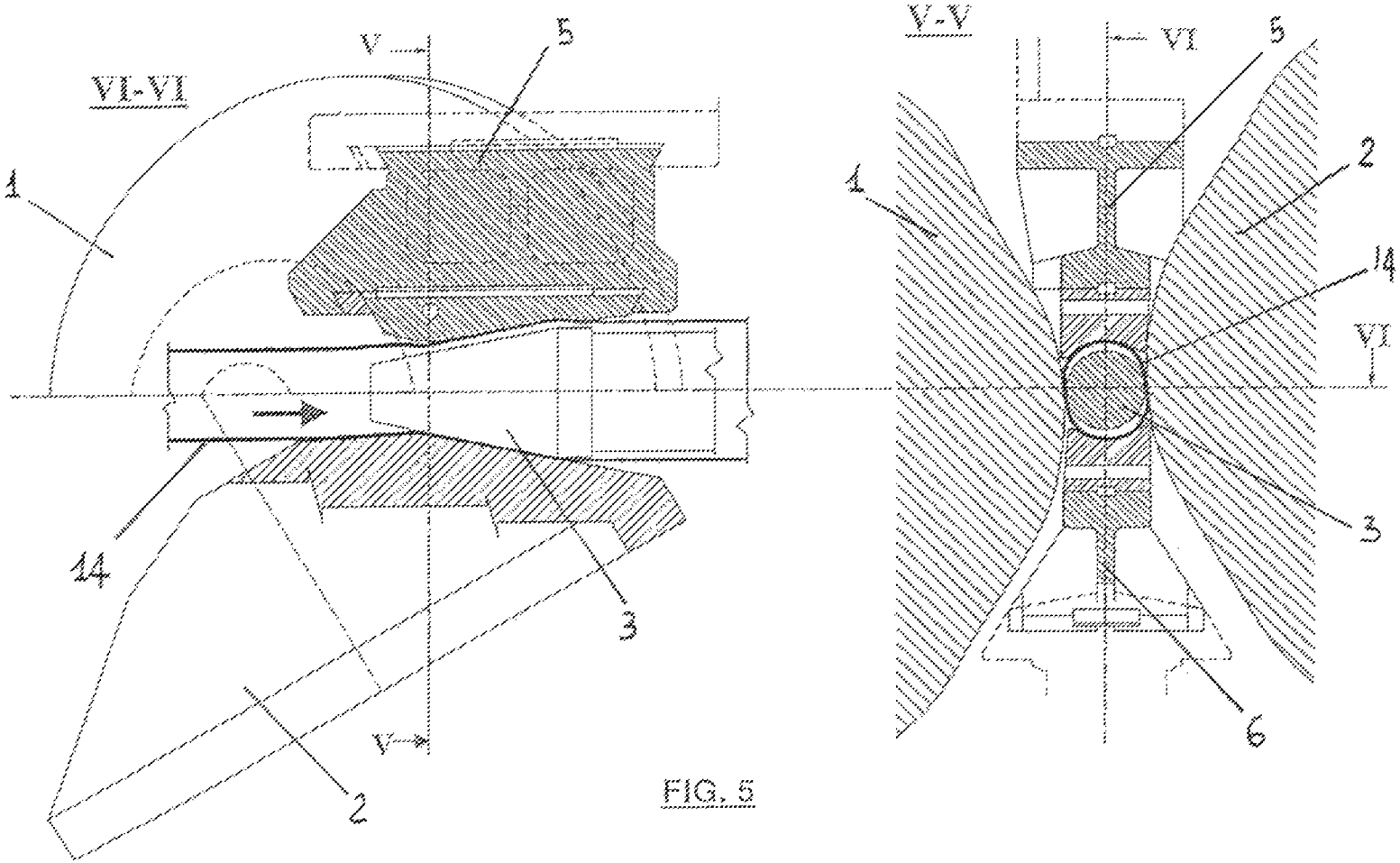
FIG. 5 shows two sections V-V and VI-VI, respectively, to enlarge the area of FIG. 1 comprising tip 3.

The rollers 7 and 8 are inclined by an angle $\gamma$ (FIG. 2) with respect to an axis in said approximately vertical direction. The angle $\gamma$ may be adjusted by means of systems, such as hydraulic cylinders 17 and/or jacks 18, controlled in a per se known manner. The angle $\gamma$ is not very large, however, in the order of 2-8° for example. The movement of the rollers 7 and 8 is such to complete the forwarding of the tube being machined, especially at the end of the rolling operation, i.e. when the tail of the tube leaves the working rollers; the tube advances with a helical type movement.

In possible variants of the roller embodiments, the rollers may be more than two, e.g. 3 or 4 with increasing practical constructional difficulties.

The stabilizing system appropriately connected to the beam allows to prevent the beam and thus the tip from fluctuating in the approximately vertical direction, i.e. approximately orthogonal to the axes of rollers 1 and 2.

The obtained result is the introduction of an additional ovalization of the tube which compensates for the residual one of the machining described above. At the outlet from the stabilizing system, the tube section is circular and straighter.

Figure 1A:
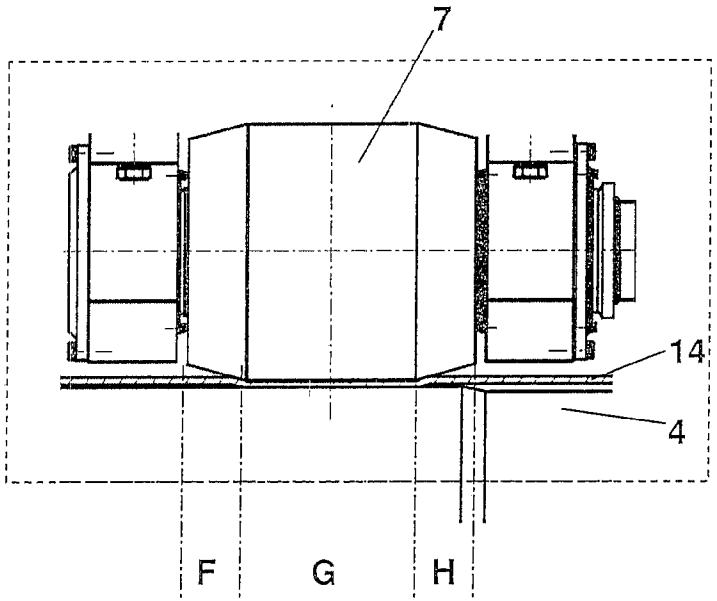
FIG. 1*a* shows an enlargement of the area in the rectangle outlined in FIG. 1 comprising the roller 7, with zones F, G, H highlighted.

The shape of the stabilizing rollers is such to form three zones (FIG. 1*a*):

- a first converging zone F to generate the additional ovalization on the tube 14;
- a second zone G such as to obtain a constant tube diameter: the length of this zone depends on the number of rollers, so that a point on the surface of the tube is touched by all the rollers before existing this zone; in the case of two rollers 7 and 8, it is longer than ½ helical pitch of the tube forwarding; the external surface of the rollers has a hyperboloidal profile in this zone;
- a third diverging zone H for recovering the tube roundness.

The second zone G also allows to additionally smooth the surface of the tube between the stabilizing ring and the stabilizing rollers, thus recovering the above-described imperfections.

The invention claimed is:

1. A rolling mill of rotating expander type for tubular bodies, comprising:

first working rollers, provided with rotation axes arranged inclined by a first angle ($\beta$) with respect to a rolling axis, and placed at determined heights diametrically opposite to the rolling axis;

a tip fitted on a beam, said tubular body being pushed so as to rotate between said first rollers and said tip, and subjected to a deformation for increasing the perimeter;

wherein the rolling mill comprises a tip-stabilizing system placed behind the tip, about the beam, and integrated in the rolling mill, said tip-stabilizing system comprising:

a) a substantially cylindrical stabilizing ring placed behind said tip within the tubular body; and b) pressure elements for exerting a pressure on an external surface of said tubular bodies against said stabilizing ring, in a direction essentially orthogonal to said first working rollers.

2. A rolling mill of rotating expander type according to claim 1, wherein said pressure elements comprise further rollers, which engage the tubular body at said stabilizing ring, so as to push the tube in contact with the stabilizing ring.

3. A rolling mill of rotating expander type according to claim 1, wherein said stabilizing ring essentially comprises a cylindrical part, which is either part of said tip itself as an extension of a truncated cone part of said tip or a separate component placed on the beam.

4. A rolling mill of rotating expander type according to claim 2, wherein said pressure elements further comprise pushing systems for said further rollers adapted to rotate by means of motorizing systems.

5. A rolling mill of rotating expander type according to claim 4, wherein said pushing systems comprise hydraulic capsules or jacks.

6. A rolling mill of rotating expander type according to claim 2, wherein said further rollers are inclined by a second angle (γ) with respect to an axis perpendicular to the axes of said first working rollers, said second angle (γ) being adjustable.

7. A rolling mill of rotating expander type according to claim 2, wherein said further rollers are shaped so as to form three zones:

a first converging zone (F) to generate an additional ovalization on said tubular body;

a second zone (G) so as to obtain a constant diameter of said tubular body;

a third diverging zone to recover the roundness of said tubular body.

8. A rolling mill of rotating expander type according to claim 7, wherein the length of said second zone depends on the number of said further rollers, so that a point on said external surface of the tubular body is touched by all the rollers before exiting said second zone, the external surface of said further rollers having an hyperboloidal profile in said second zone.

9. A method of machining a tubular body characterized in that it uses a rolling mill of rotating expander type comprising:

first working rollers, provided with rotation axes arranged inclined by a first angle (β) with respect to the rolling axis, and placed at determined heights diametrically opposite to the rolling axis;

a tip fitted on a beam, said tubular body being pushed so as to rotate between said first rollers and said tip, and subjected to a deformation for increasing the perimeter;

wherein the rolling mill comprises a tip-stabilizing system placed behind the tip, about the beam, and integrated in the rolling mill, said tip-stabilizing system comprising:

a) a substantially cylindrical stabilizing ring placed behind said tip within the tubular body; and b) pressure elements for exerting a pressure on the external surface of said tubular bodies against said stabilizing ring, in a direction essentially orthogonal to said first working rollers.

* * * * *